US007971839B2

(12) United States Patent
Upchurch

(10) Patent No.: US 7,971,839 B2
(45) Date of Patent: Jul. 5, 2011

(54) EQUIPMENT MOUNT FOR WATERBORNE VESSELS

(76) Inventor: John Upchurch, Irvine, CA (US)

( * ) Notice: Subject to any disclaimer, the term of this patent is extended or adjusted under 35 U.S.C. 154(b) by 231 days.

(21) Appl. No.: 12/418,009

(22) Filed: Apr. 3, 2009

(65) Prior Publication Data

US 2009/0250563 A1 Oct. 8, 2009

Related U.S. Application Data

(60) Provisional application No. 61/123,129, filed on Apr. 4, 2008.

(51) Int. Cl.
*F16M 11/00* (2006.01)

(52) U.S. Cl. ..... 248/276.1; 248/278.1; 248/121; 367/173

(58) Field of Classification Search ..... 114/123; 248/278.1, 641; 367/173
See application file for complete search history.

(56) References Cited

U.S. PATENT DOCUMENTS

| | | | | |
|---|---|---|---|---|
| 3,740,706 | A * | 6/1973 | Joseph | 367/173 |
| 3,941,072 | A * | 3/1976 | Caton et al. | 114/165 |
| 3,989,213 | A | 11/1976 | Allen | |
| 3,989,216 | A | 11/1976 | Veatch | |
| 4,063,359 | A * | 12/1977 | Luscombe | 30/379.5 |
| 4,285,485 | A | 8/1981 | Burke | |
| 4,928,915 | A * | 5/1990 | Havins | 248/288.31 |
| 4,980,872 | A * | 12/1990 | Oler et al. | 367/173 |
| D325,880 | S * | 5/1992 | Havins | D10/80 |
| 5,243,928 | A | 9/1993 | Brenaman | |
| D344,239 | S * | 2/1994 | Suggs | D10/65 |
| 5,662,505 | A | 9/1997 | Spriggs | |
| 5,996,527 | A | 12/1999 | Ambrozic | |
| 6,027,387 | A | 2/2000 | Allin | |
| 6,053,471 | A * | 4/2000 | Brown | 248/642 |
| 6,065,420 | A | 5/2000 | Smith | |
| 6,645,025 | B2 | 11/2003 | Oathout | |
| 6,755,145 | B2 | 6/2004 | Bolebruch | |
| 6,791,902 | B1 | 9/2004 | Steiner et al. | |
| 6,840,190 | B2 | 1/2005 | Godek | |
| 6,964,243 | B1 | 11/2005 | Thompson | |
| 7,036,451 | B1 * | 5/2006 | Hutchinson | 114/364 |
| 7,121,225 | B1 | 10/2006 | Caples | |
| 7,124,702 | B1 | 10/2006 | Cameron | |
| 2006/0023570 | A1 | 2/2006 | Betts et al. | |
| 2006/0050615 | A1 * | 3/2006 | Swisher | 367/173 |

FOREIGN PATENT DOCUMENTS

| | | |
|---|---|---|
| JP | 07257478 | 10/1995 |

* cited by examiner

*Primary Examiner* — Terrell McKinnon
*Assistant Examiner* — Daniel J Breslin
(74) *Attorney, Agent, or Firm* — Knobbe Martens Olson & Bear, LLP

(57) ABSTRACT

An apparatus for mounting equipment on a waterborne vessel includes a base member configured to support an instrument. An elongate spacer arm is connected to the base member. A selectively deployable elongate transducer arm is pivotably coupled to the spacer arm. The transducer arm is configured to pivot between a deployed position and a stored position. The length of the transducer arm is at least sufficient for the transducer end to reach the water surface when the transducer arm is in the deployed position. The spacer arm is substantially parallel to or collinear with the transducer arm when the transducer arm is in the stored position, allowing the apparatus to be folded for compact storage.

13 Claims, 13 Drawing Sheets

EQUIPMENT MOUNT FOR WATERBORNE VESSELS

CROSS-REFERENCE TO RELATED APPLICATIONS

This application claims the benefit under 35 U.S.C. §119 (e) of U.S. Provisional Patent Application No. 61/123,129, entitled "EQUIPMENT MOUNT FOR WATERBORNE VESSELS," filed Apr. 4, 2008, the entire contents of which are incorporated by reference herein and made a part of this specification.

BACKGROUND

1. Field

This disclosure relates generally to waterborne vessel accessories, and more particularly, to mounts configured to deploy underwater marine detection equipment.

2. Description of Related Art

Operators of waterborne vessels sometimes wish to attach equipment such as navigation instruments and/or safety instruments to their watercraft. Some types of equipment have parts that need to be submerged in order to function properly. For example, a fish finder is a type of echo sounding system that uses an underwater transducer known as a hydrophone to detect the position of fish underneath the surface of the water. One technique that fishing enthusiasts have used to attach the hydrophone to the craft in the past has included gluing the hydrophone to the underside of the hull. Existing techniques for deploying underwater marine detection equipment from a watercraft suffer from various drawbacks.

SUMMARY

Embodiments described herein have several features, no single one of which is solely responsible for their desirable attributes. Without limiting the scope of the invention as expressed by the claims, some of the advantageous features will now be discussed briefly.

In some embodiments, an apparatus for mounting equipment on a waterborne vessel includes a base member configured to support an instrument. An elongate spacer arm is connected to the base member. The elongate spacer arm includes a base member end configured to connect to the base member and a distal end opposite the base member end. The length of the spacer arm is at least sufficient for the distal end to reach an outside edge of the vessel when the base member is mounted on the vessel. A selectively deployable elongate transducer arm is pivotably coupled to the spacer arm. The elongate transducer arm includes a proximal end configured to pivotably connect to the distal end of the spacer arm and a transducer end opposite the proximal end. The transducer end is configured to attach to a transducer. The transducer arm is configured to pivot between a deployed position and a stored position. The length of the transducer arm is at least sufficient for the transducer end to reach the water surface when the transducer arm is in the deployed position. The spacer arm is substantially parallel to or collinear with the transducer arm when the transducer arm is in the stored position, allowing the apparatus to be folded for compact storage.

Additional embodiments provide a method of using an equipment mount to deploy a transducer from a waterborne vessel. The method includes securing a base to a deck of the waterborne vessel. The base is connected to a spacer arm and a transducer arm that is pivotably attached to the spacer arm. The method further includes providing an instrument having a display unit and a transducer, placing the display unit on the base, fastening the transducer to an end of the transducer arm opposite a portion of the transducer arm attached to the spacer arm, and swinging the transducer arm to rotate the transducer arm from a stored position to a deployed position. The transducer arm is parallel to or collinear with the spacer arm when the transducer arm is in the stored position. The transducer is positioned underwater when the transducer arm is in the deployed position.

BRIEF DESCRIPTION OF THE DRAWINGS

The following drawings and the associated descriptions are provided to illustrate embodiments of the present disclosure and do not limit the scope of the claims.

DETAILED DESCRIPTION OF PREFERRED EMBODIMENTS

Figure 1:
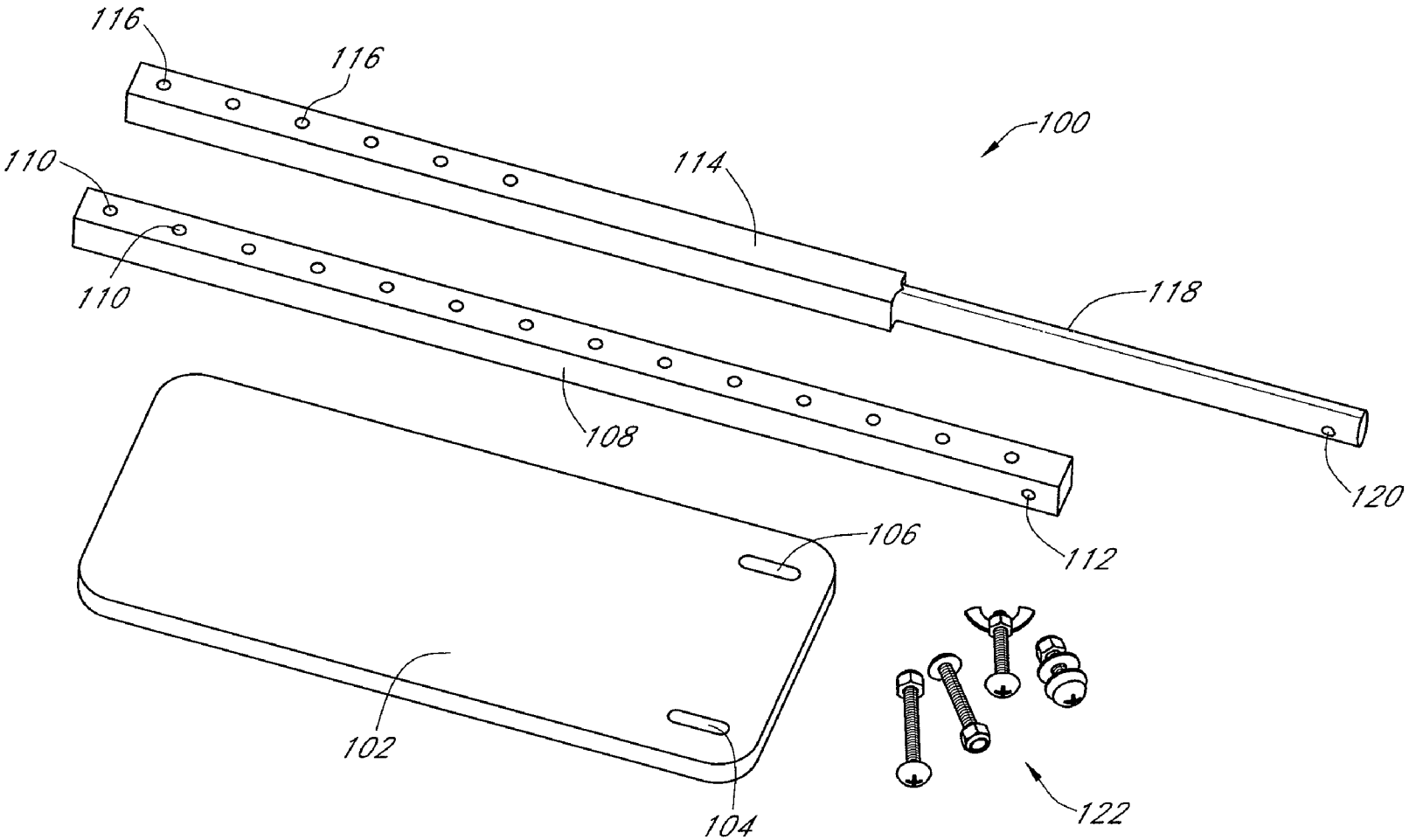
FIG. 1 depicts the unassembled parts of one embodiment of a mounting apparatus.

Although certain preferred embodiments and examples are disclosed herein, inventive subject matter extends beyond the specifically disclosed embodiments to other alternative embodiments and/or uses of the inventions, and to modifications and equivalents thereof. Thus, the scope of the inventions herein disclosed is not limited by any of the particular embodiments described below. For example, in any method or process disclosed herein, the acts or operations of the method or process may be performed in any suitable sequence and are not necessarily limited to any particular disclosed sequence.

For purposes of contrasting various embodiments with the prior art, certain aspects and advantages of these embodiments are described. Not necessarily all such aspects or advantages are achieved by any particular embodiment. Thus, for example, various embodiments may be carried out in a manner that achieves or optimizes one advantage or group of advantages as taught herein without necessarily achieving other aspects or advantages as may also be taught or suggested herein. While some of the embodiments are discussed in the context of particular varieties or designs of waterborne vessels, it is understood that the inventions may be used with other types of watercraft. Furthermore, while some of the embodiments are discussed in the context of particular types of equipment, such as fish finders, it is recognized that the inventions may be used with other types of equipment that can be deployed underwater.

As interest in fishing from small watercraft, such as kayaks, has increased, fishing enthusiasts have sought to attach fishing equipment, including electronic devices, to their small craft. Some types of equipment, such as fish finders, have parts that need to be submerged in order to function properly. For example, a hydrophone may not function properly if it is not underwater. Installing such equipment on kayaks has proven problematic. For example, gluing the hydrophone to the underside of the hull may result in the hydrophone being difficult to remove and exposed to risk of damage.

In some embodiments, an equipment mount is configured to rest on or attach to a top surface of the deck of a watercraft. The equipment mount can include a platform configured to support an instrument, such a fish finder display. A first elongate member, known, for example, as a spacer arm or an offset arm, can be connected to the platform. In some embodiments, the spacer arm has a length sufficient to reach from the platform to beyond an outer edge of the watercraft, such as, for example, the craft's gunwale. The spacer arm can be pivotably coupled to a first end of a second member, known as a transducer arm or a deployment arm, for example, to form a pivoting deployment arm. In some embodiments, the deployment arm has a length sufficient so that a transducer fixed to a second opposite end of the transducer arm can reach the surface of the water when deployed. By swinging the transducer arm, a user can selectively fold the equipment mount for compact storage or deploy the transducer into the water.

In the embodiment shown in FIG. 1, the unassembled parts of one embodiment of a mounting apparatus are depicted. The mounting apparatus 100 includes a platform 102 which, in the illustrated embodiment, has a substantially planar top and bottom surface. The platform 102 can be constructed from any suitable material such as, for example, plastic, thermoplastic, metal, or wood.

In the embodiment shown in FIG. 1, the platform 102 includes a first aperture 104 and a second aperture 106 configured to permit a spacer arm 108 to be connected to the platform 102. The spacer arm 108 includes apertures 110 through which fasteners 122 can be inserted to secure the spacer arm 108 to the platform 102. The spacer arm 108 can also be known as an off-set arm. Apertures 110 can be placed at a proximal end of the spacer arm 108 and preferably are spaced at any suitable interval along up to the entire length of the spacer arm 108. Near a distal end of the spacer arm 108 a second aperture 112 is situated in the spacer bar 108 such that a transducer arm 114 can be connected to the spacer arm 108. In some embodiments, the length of the spacer arm 108 is at least sufficient such that when the spacer arm 108 is connected to the platform 102, the second aperture 112 of the spacer arm 108 is positioned outside the outer edge of the vessel's hull. The platform 102 can be sized to support an instrument such as, for example, the display of a fish finder.

The transducer arm 114 includes one or more apertures 116 positioned and sized to allow the spacer arm 108 to be connected to the transducer arm 114, for example, via aperture 112. One or more fasteners 122 can be used to attach the transducer arm 114 to the spacer arm 108. As shown in FIG. 1, the transducer arm preferably includes a tapered portion 118 at an end opposite the point of attachment between the transducer arm 114 and the spacer arm 108. The tapered portion 118 preferably is somewhat more flexible than the other portions of the transducer arm 114. At the end of the transducer arm 114 is a transducer attachment aperture 120, positioned and sized such that a transducer, such as, for example, a hydrophone can be connected thereto. The length of the transducer arm 114 is at least sufficient such that a transducer connected to the transducer arm 114 reaches the surface of the water when the transducer arm 114 is connected to the spacer arm 108.

Figure 2:
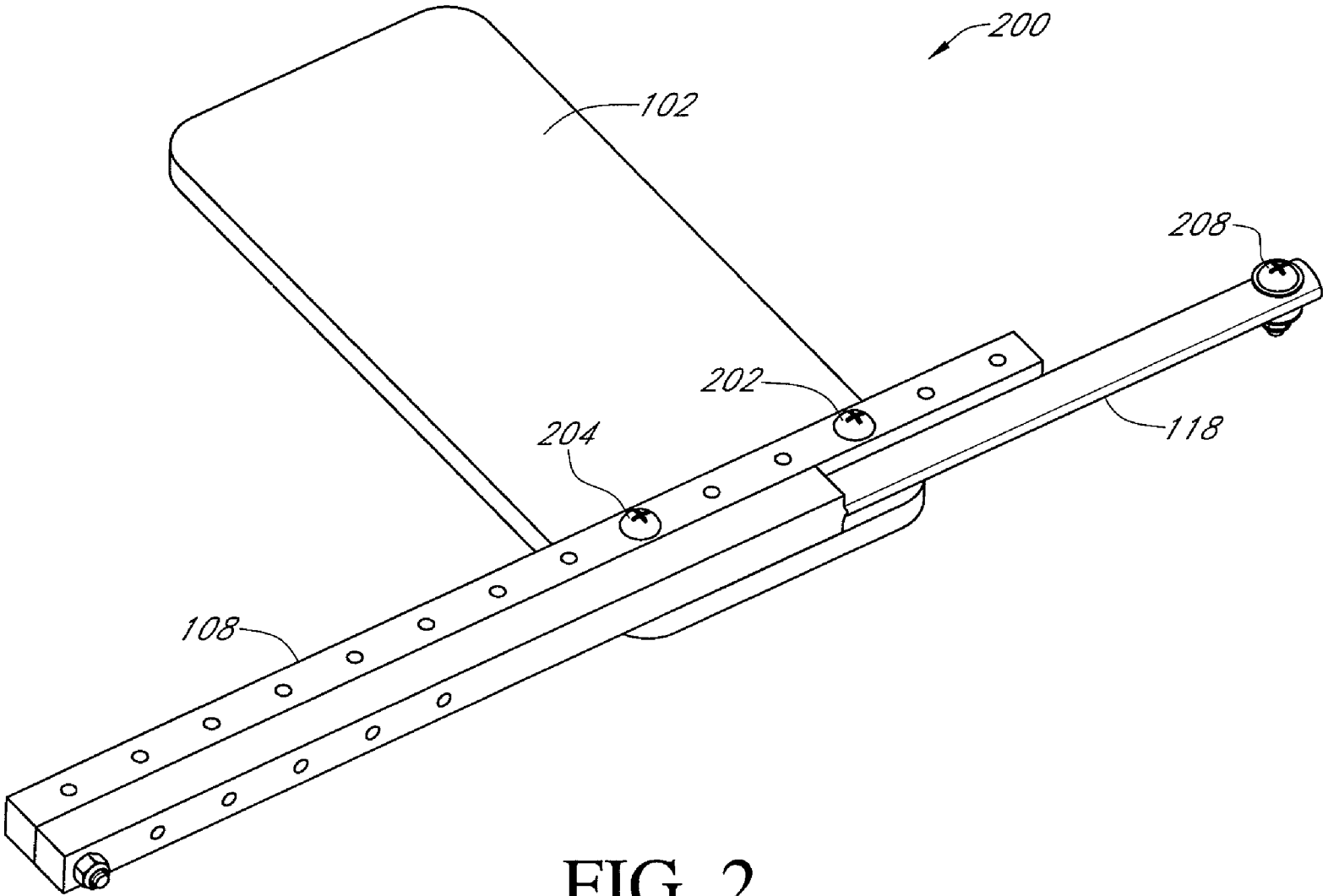
FIG. 2 depicts an embodiment of a mounting apparatus folded for compact storage.

FIG. 2 depicts an assembled mounting apparatus 200. In the assembled mounting apparatus 200, the spacer arm 108 is connected to the platform 102 at a first attachment portion 202 and a second attachment portion 204. The position of the spacer arm 108 is fixed with respect to the platform 102. The transducer arm 114 is connected to the spacer arm 108 at a pivoting attachment portion 206. A fastener at the pivoting attachment portion 206 is configured to allow the transducer arm 114 to rotate or swing in a plane that is parallel to the spacer arm 108. A transducer attachment portion 208 is situated at an end opposite the pivoting attachment portion 206 on the transducer arm 114. In the embodiment shown in FIG. 2, the transducer arm 114 is depicted in a stored position with respect to the spacer arm 108. In the stored position, the transducer arm 114 is parallel to the spacer arm 108. When the transducer arm 114 is in the stored position, the mounting apparatus 200 is positioned to facilitate compact storage of any equipment mounted thereto.

In some embodiments, the mounting apparatus 200 can have additional features that contribute to the compactness of its design. For example, the transducer arm 114 and/or the spacer arm 108 can include telescoping portions such that the length and/or width of the mounting apparatus is further decreased when the arms 108, 114 are stored. In some embodiments, the transducer arm 114 and/or the spacer arm 108 include multiple segments connected by bendable joints, allowing the arms 108, 114 to be folded one or more times. In some embodiments, the transducer arm 114 is collinear with the spacer arm 108 in the folded position. For example, the transducer arm 114 can be rotated such that it is in a position collinear with the spacer arm 108, and then one or more telescoping or folding portions of the spacer arm 108 and/or transducer arm 114 can be collapsed. In certain embodiments, at least one of the spacer arm 108 and the transducer arm 114 is configured to telescope so as to have an adjustable length.

Figure 3:
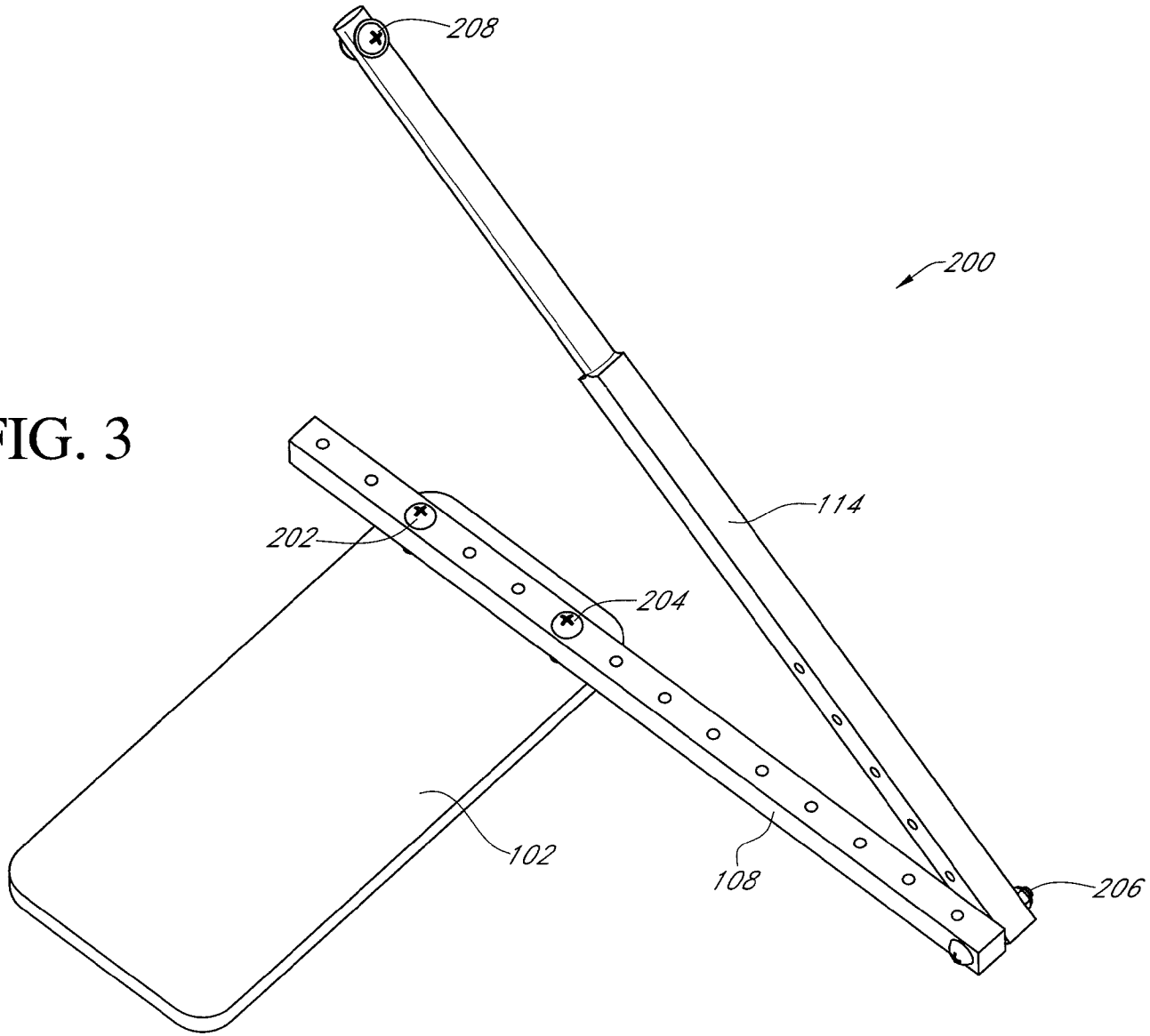
FIG. 3 depicts the embodiment of FIG. 2 with a transducer arm partially deployed.

FIG. 3 depicts an embodiment of the assembled mounting apparatus 200 in which the transducer arm 114 is shown in a partially deployed position. The transducer arm 114 is deployed by swinging the arm 114 around an axis of rotation that is co-axial with a fastener at attachment portion 206. The fastener can be, for example, a combination of a threaded bolt and a nut. The nut can be positioned along the threaded bolt to allow the transducer arm 114 to swing freely with respect to the spacer arm 108. The nut can also be positioned to allow a suitable amount of friction between the transducer arm 114 and the spacer arm 108. For example, the nut can be positioned such that the transducer arm 114 swings when a user pulls on the transducer arm 114 but otherwise remains stationary with respect to the spacer arm 108. By adjusting the deployment angle of the transducer arm 114 (for example, where the deployment angle is the angle between the transducer arm 114 and the spacer arm 108), a user of the mounting apparatus 200 can select a measurement angle for a transducer attached to the transducer arm 114. For example, when the deployment angle of the transducer arm 114 is 90°, the measurement angle can be straight down towards the floor of the body of water in which the vessel is operating. Changing the deployment angle can allow the user to select a measurement angle for the transducer other than straight down.

Figure 4:
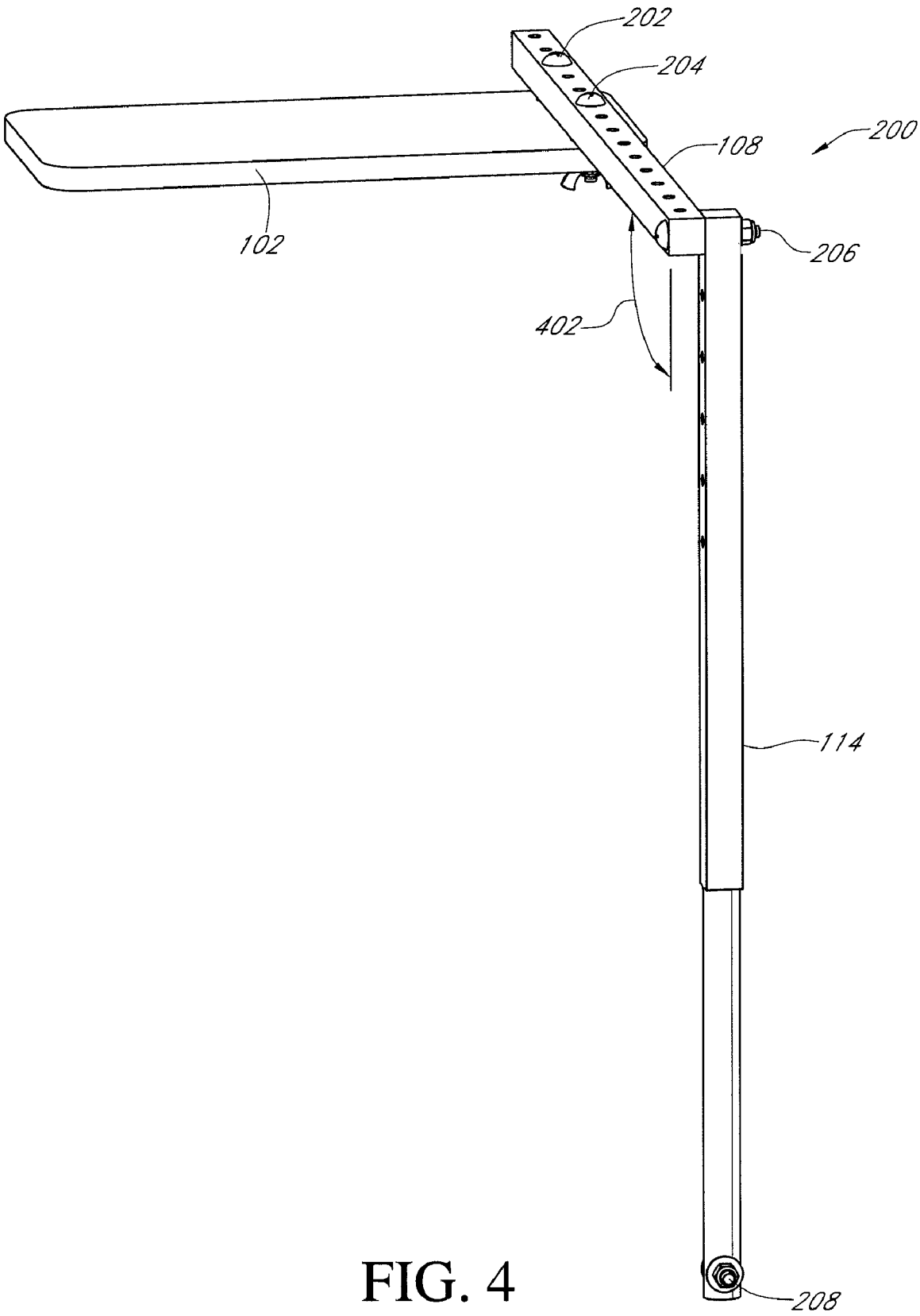
FIG. 4 depicts the embodiment of FIG. 2 with a transducer arm fully deployed.

FIG. 4 shows an embodiment of a mounting apparatus 200 that is assembled and deployed such that the transducer arm 114 is at a deployment angle 402 with respect to the spacer arm 108. In some embodiments, the deployment angle 402 is approximately 90°. A user of the mounting apparatus 200 can place the deployment arm 114 at the deployment angle by, for example, lifting the deployment arm 114 from a stored position and swinging the deployment arm 114 through a 270° arc about an axis of rotation that is co-axial with a fastener at attachment portion 206. The transducer arm 114 is swung until the deployment angle 402 is reached. When the transducer arm 114 is in the deployed position, at least a portion of a transducer connected to the transducer arm 114 at attachment portion 208 is beneath the surface of the water.

Figure 5:
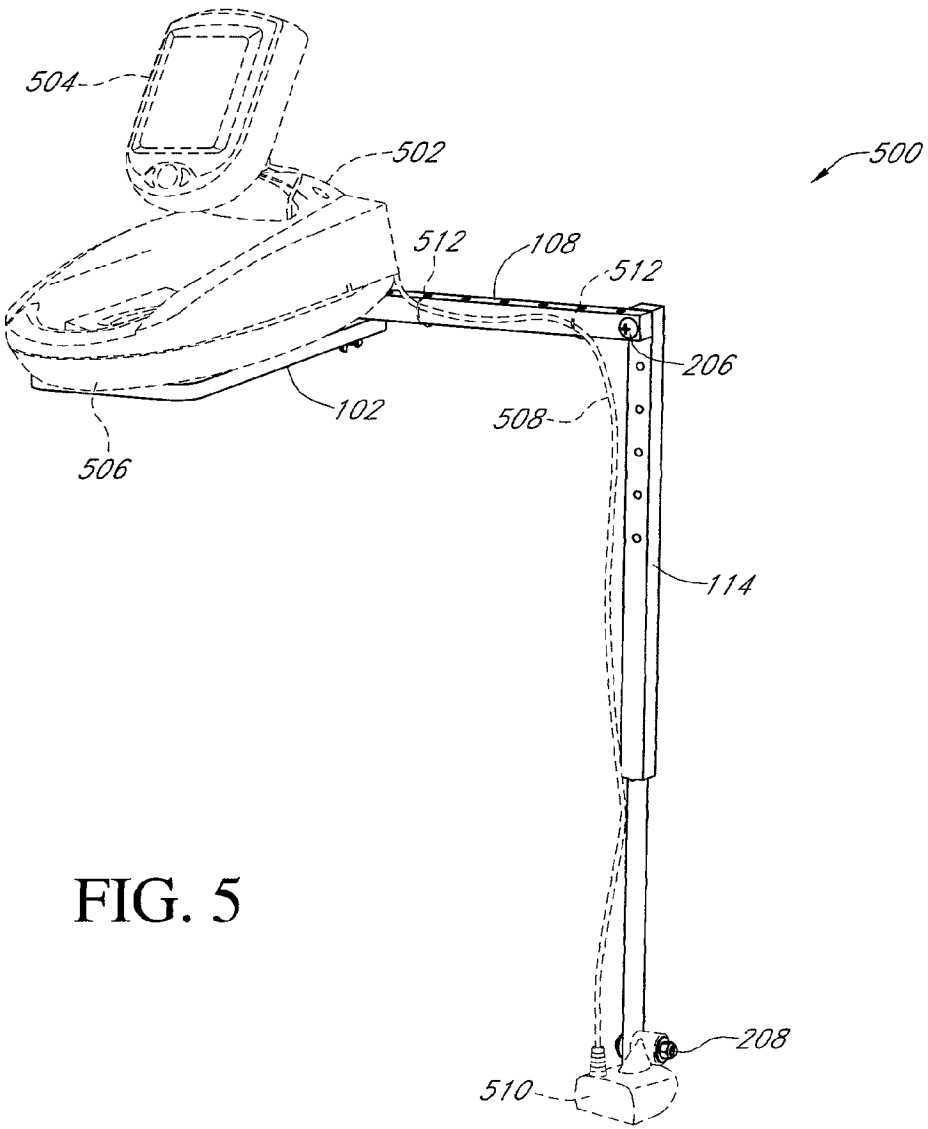
FIG. 5 depicts the embodiment of FIG. 2 with equipment attached thereto.

FIG. 5 depicts a fish finder apparatus 500 configured to attach to a vessel. The fish finder apparatus 500 includes the mounting apparatus 200 described previously and one or more pieces of equipment connected to the mounting apparatus 200. In the embodiment shown in FIG. 5, a fish finder display unit 502 is connected to the platform 102. The fish finder display unit 502 includes a display 504 and a display holder 506. The fish finder display unit 502 can be fastened to the platform 102 or can simply rest on top of a surface of the platform 102. The fish finder display unit 502 is connected to a hydrophone 510 by a transducer cord 508. In some embodiments, a transducer cord 508 is not used to attach the transducer 510 to the fish finder display unit 502. Instead, a wireless connection or another type of connectivity is used to relay information from the transducer 510 to the display unit 502. The hydrophone is connected to the transducer arm 114 at the transducer attachment portion 208. The transducer cord 508 preferably is routed along the length of the transducer arm 114 and the spacer arm 108. One or more cable guides 512 can be used to position the cable alongside the transducer arm 114, the spacer arm 108, or both the transducer arm 114 and the spacer arm 108.

Figure 6:
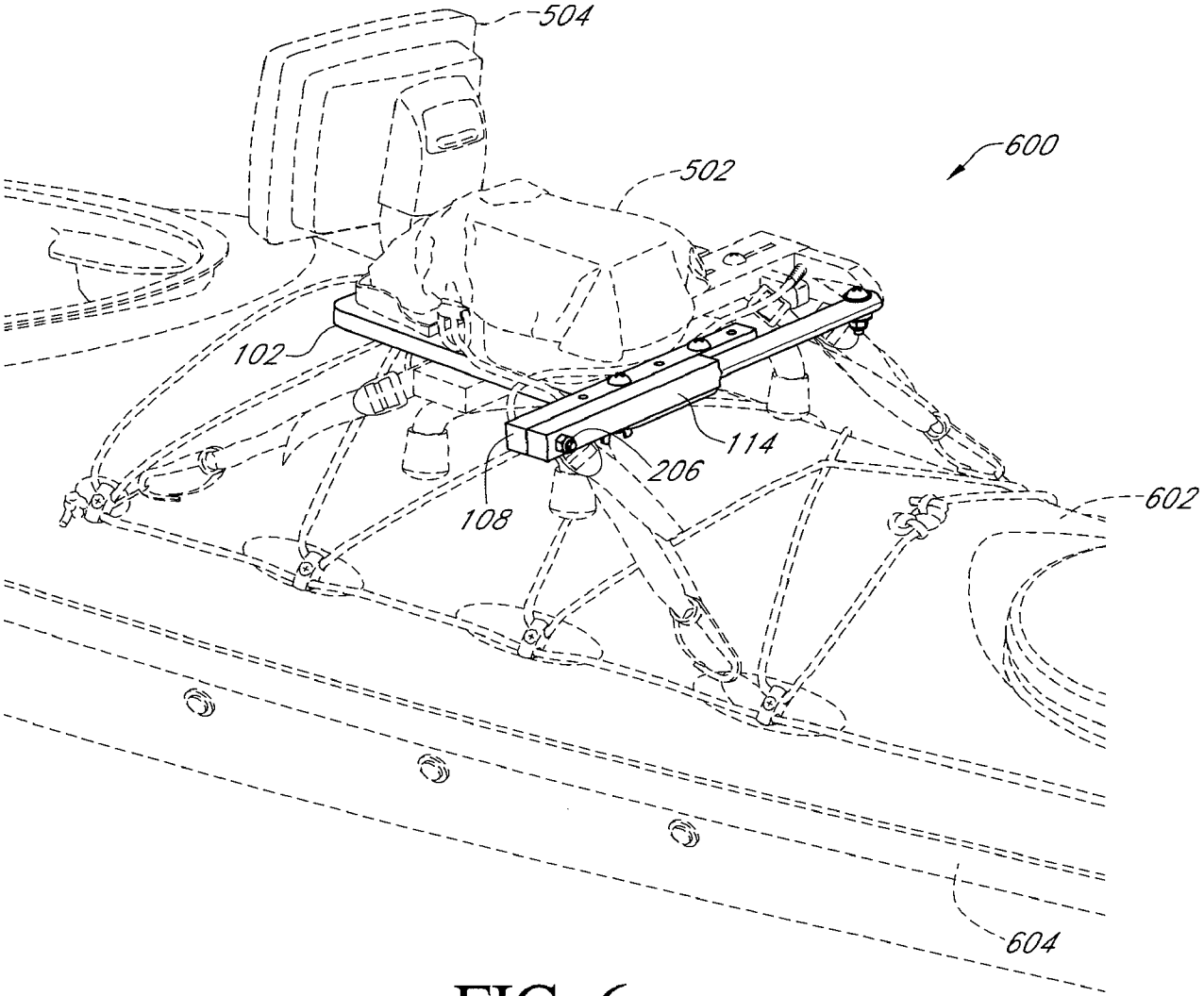
FIG. 6 depicts an embodiment of a mounting apparatus attached to a kayak with a transducer arm in a stored position.

FIG. 6 depicts a fishing kayak 600 on which a fish finder apparatus 500 is secured. The fish finder apparatus 500 rests on the deck 602 of the fishing kayak 600. In the embodiments shown in FIG. 6, the transducer arm 114 to which the hydrophone is attached, is in the stored position. When the transducer arm 114 is in the stored position, the transducer arm 114 is substantially parallel to the spacer arm 108. The spacer arm 108 is attached to the platform 102 on which the fish finder display unit 502 is mounted. When the fish finder apparatus 500 is installed on the fishing kayak 600, the transducer arm attachment portion 206 on the spacer arm 108 and the transducer arm 114 is positioned outside the area defined by the outer edge 604 of the hull of the kayak 600.

In some embodiments, the mounting apparatus 100 and fish finder apparatus 500 connected thereto are removable as a unit from the kayak 600. The mounting apparatus 100 and/or fish finder apparatus 500 can be folded into a stored position for compact storage. The compact stored unit can is easily reinstalled. In some embodiments, the unit can also be easily moved and secured to another watercraft in a minimal amount of time. The mounting apparatus 100 preferably allows the fish finder apparatus 500 to be speedily installed and uninstalled on a craft. In some embodiments, the process of installation and uninstallation of the fish finder apparatus 500 on a craft is significantly faster with the mounting apparatus 100 than without.

Figure 7:
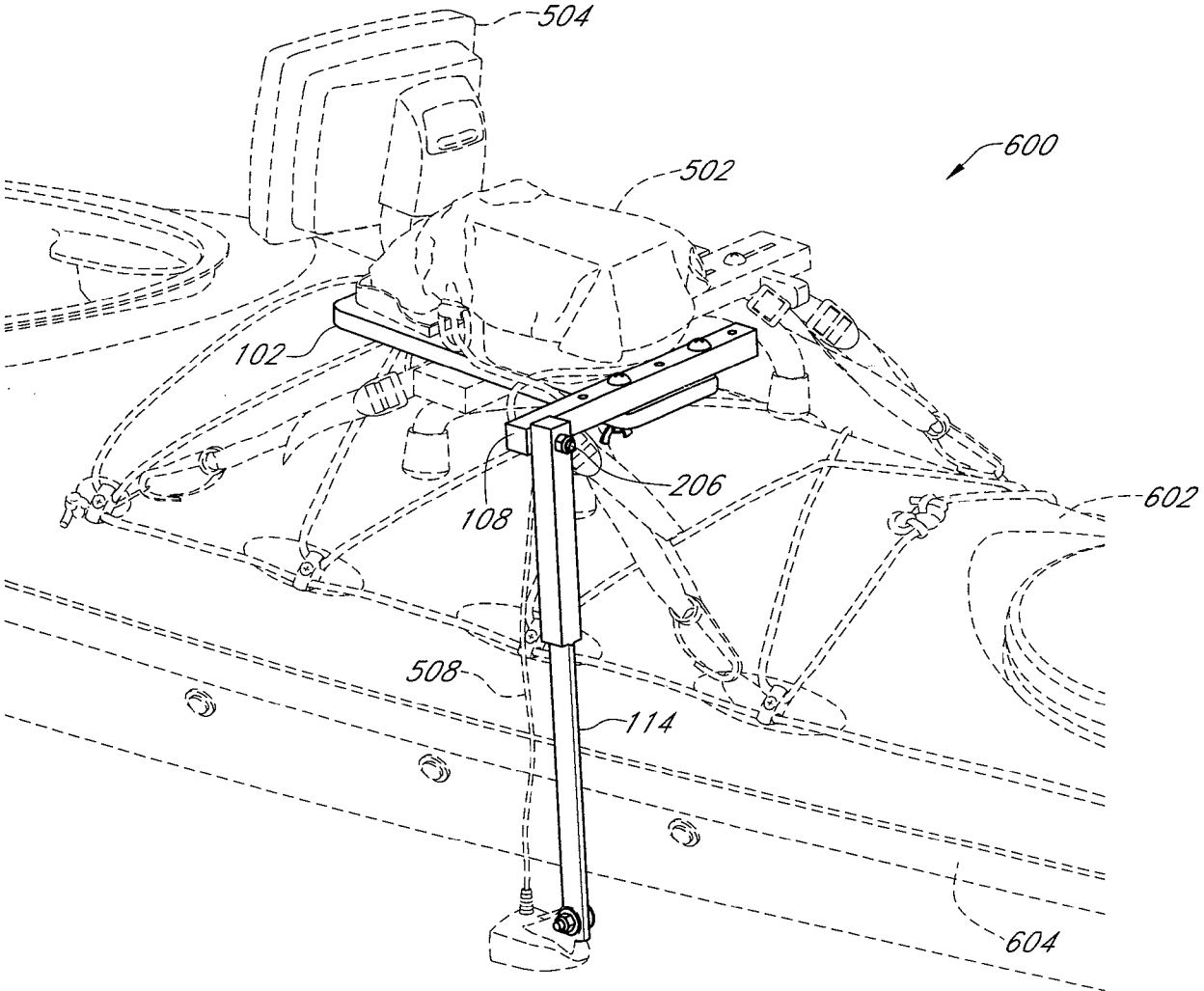
FIG. 7 depicts the arrangement of FIG. 6 with a transducer arm in a deployed position.

FIG. 7 depicts an embodiment of the fishing kayak 600 in which the transducer arm 114 of the fish finder apparatus 500 is in a deployed position. When the fish finder apparatus 500 is in a deployed position, the transducer arm 114 preferably is entirely outside the perimeter defined by the outer edge 604 of the kayak's hull so that the transducer arm 114 has an unobstructed path to the surface of the water. When the fishing kayak 600 is placed in a body of water, and when the fish finder is in the deployed position, the hydrophone 510 is positioned to be beneath the surface of the water. The transducer arm 114 can also be adjusted to other angles with respect to the spacer arm 108 such that measurements can be taken with the hydrophone 510 at various angles with respect to the surface of the water.

Figure 8:
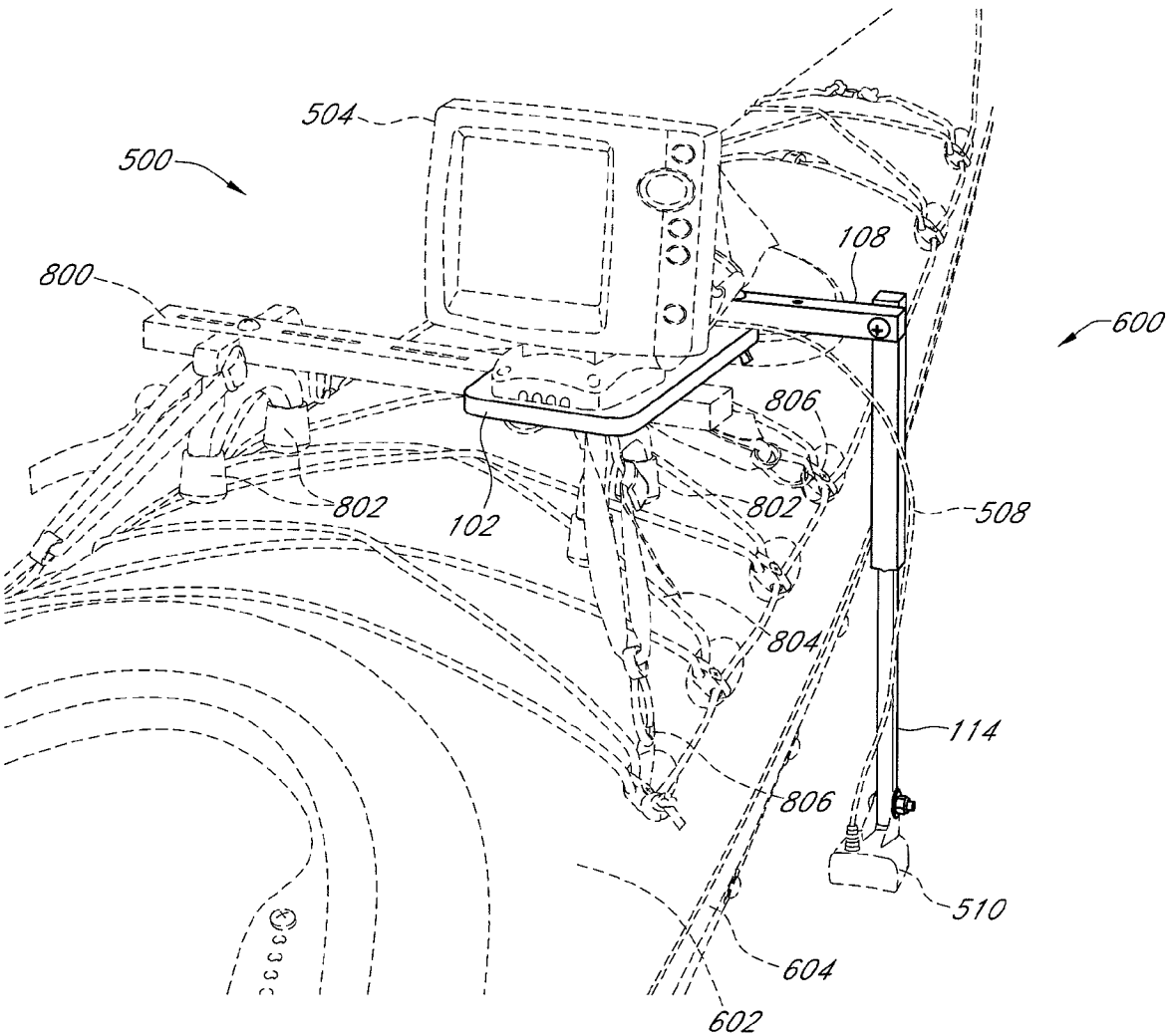
FIG. 8 depicts another view of the arrangement of FIG. 7.

FIG. 8 shows a fishing kayak 600 with a fish finder apparatus 500 secured to a mount member 800. The mount member 800 includes supports 802 that rest on the deck 602 of the fishing kayak 600. The supports 802 can include high friction material that prevents the mount 800 from slipping on the deck 602 of the kayak 600. The mount 800 can be secured to the kayak 600 using ties 804 that attach to the kayak at attachment portions 806 along the hull of the kayak 600. In some embodiments, the mount member 800 is integrated with one or more portions of the mounting apparatus 200. For example, the mount member 800 can be integral with the platform 102.

Figure 9:
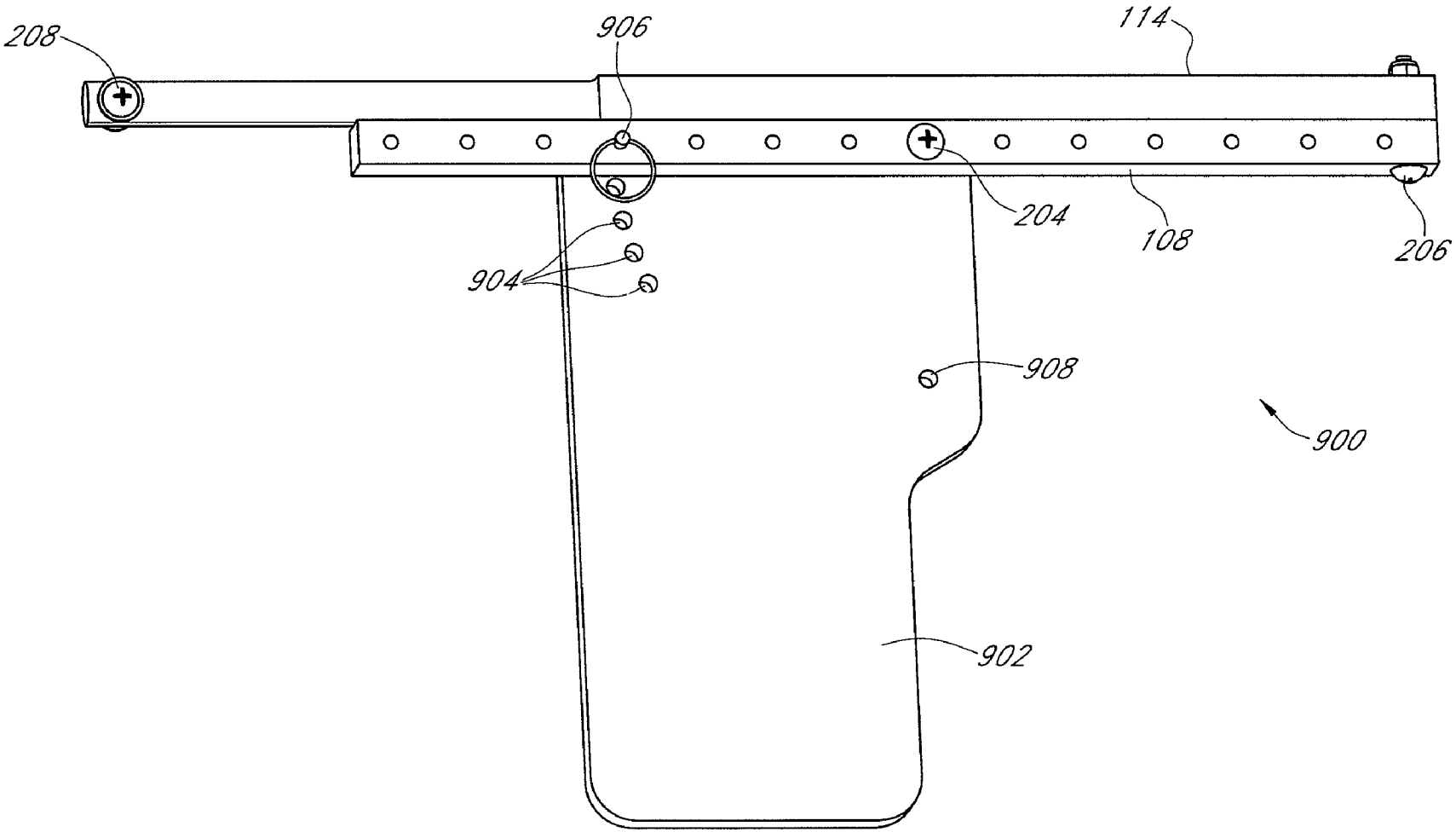
FIG. 9 depicts an embodiment of a mounting apparatus with a spacer arm that can be pivoted with respect to a platform.

FIG. 9 shows an embodiment of a mount member 900 that is configured to allow the spacer arm 108 to be rotated in a plane substantially parallel to a plane defined by a surface of the platform 902. In the embodiment shown in FIG. 9, the platform 902 includes a plurality of apertures 904 (for example, locking pin receptacles) that allow the angle of the spacer bar 108 to be adjusted with respect to the platform 902. A removable fastener 906, such as, for example, a locking pin, can be used to secure the spacer arm 108 at a selectable locking position on the platform 902. A second fastener 204 secures the spacer arm 108 to the platform 902 at a second location. When the removable fastener 906 is removed from the platform 902, the spacer arm 108 can pivot about an axis of rotation that is coaxial with the fastener 204. A user of the mounting apparatus 900 can then rotate the spacer arm 108 until a desired angle is reached with respect to the platform 902. When the desired angle is reached, the removable fastener 906 can be reinserted through an aperture 904 in the platform 902. The removable fastener 906 and the other fastener 204 secure the spacer arm 108 in a selectably fixed position with respect to the platform 902. The platform 902 can include another aperture 908 that is positioned along a line that extends substantially longitudinally with respect to the kayak and along which fastener 204 is located.

Figure 10:
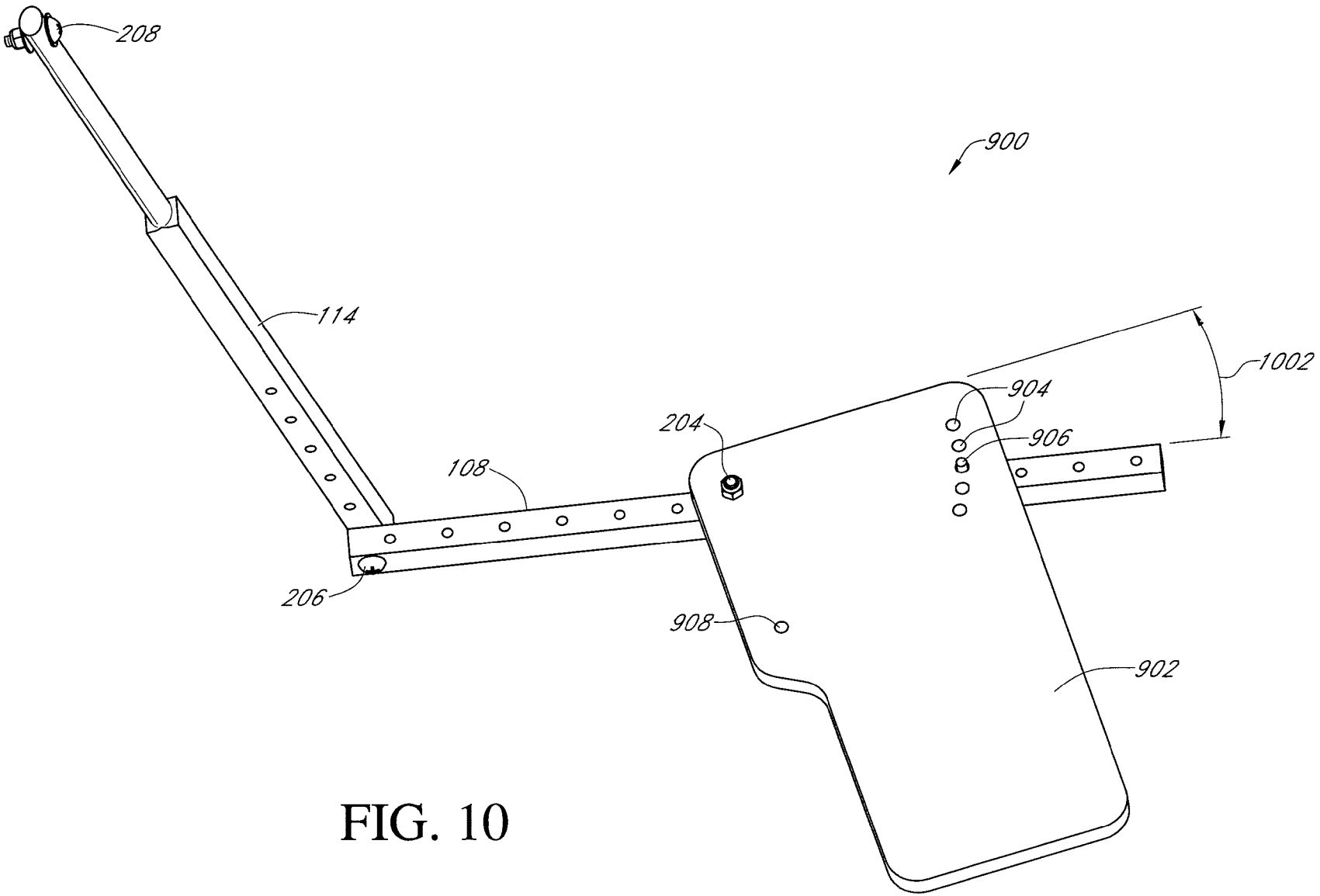
FIG. 10 depicts an embodiment of a mounting apparatus with a transducer arm deployed and with a spacer arm situated and fixed at an angle with respect to the platform.

FIG. 10 shows an embodiment of a mounting apparatus 900 in which the spacer arm 108 is adjusted to be at a spacer arm angle 1002 with respect to the platform 902 (i.e., where the spacer arm angle is the angle between a line extending in a substantially transverse direction with respect to the kayak and a line extending along the length of the spacer arm 108). In order to adjust the mounting apparatus 900 into this configuration, a user would remove the removable fastener 906 from the platform 902, rotate the spacer arm 108 until it reaches the desired angle 1002 with respect to the platform 902, and reinsert the removable fastener 906 through an aperture 904 in the platform 902. In this manner, the spacer arm angle 1002 can be adjusted such that a transducer attached at transducer attachment portion 208 can be deployed at a variety of different measurement angles.

Figure 11:
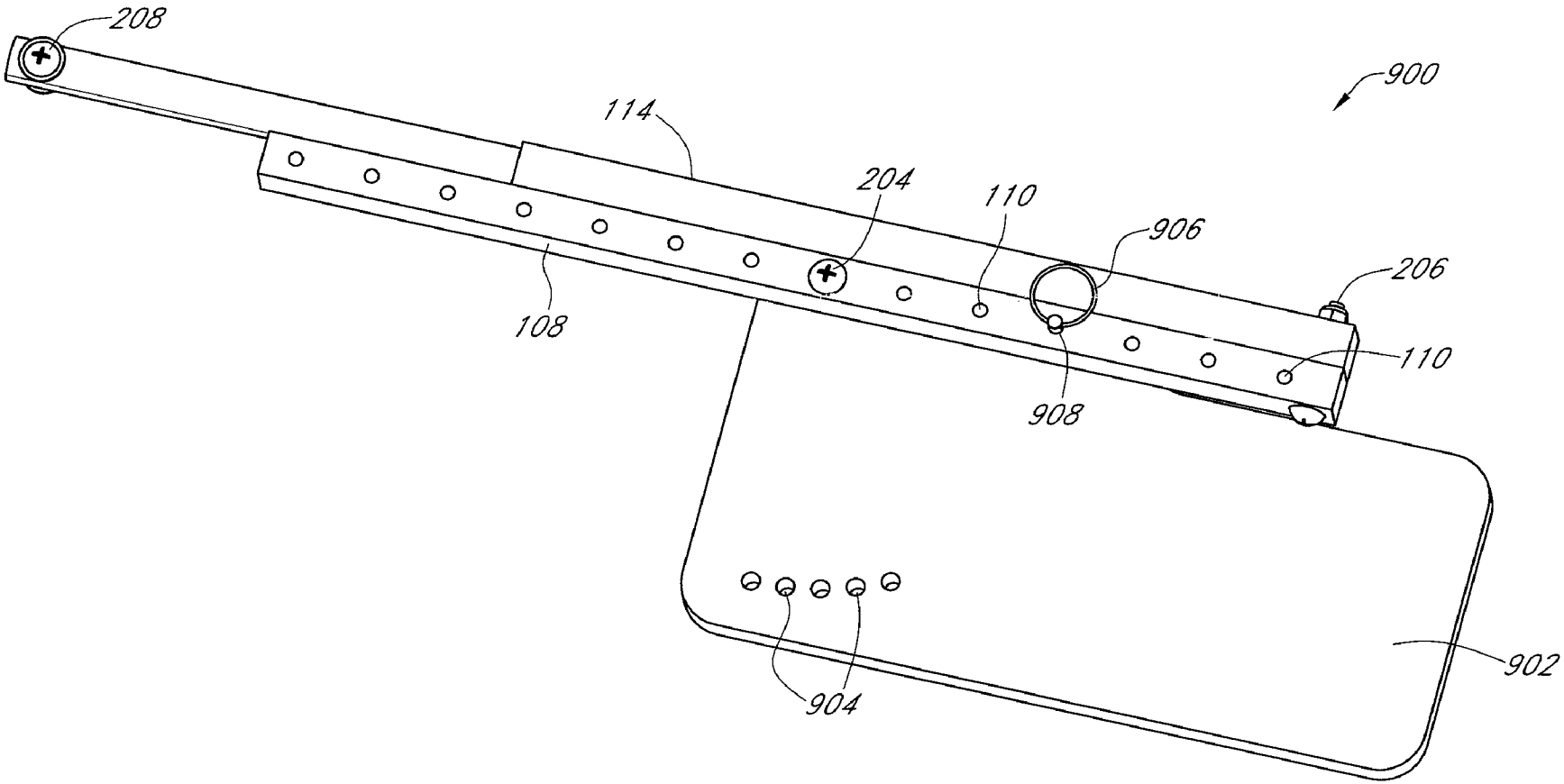
FIG. 11 depicts an embodiment of a mounting apparatus with a spacer arm secured in a longitudinal position.

FIG. 11 shows an embodiment of a mounting apparatus 900 in which the spacer arm 108 is rotated into a longitudinal position. A user of the mounting apparatus 900 may wish to place the spacer arm 108 in the longitudinal position in order to keep the spacer arm 108 and the transducer arm 114 from obstructing the user's operation of the fishing kayak. A user can place the spacer arm 108 in the longitudinal position by removing the removable fastener 906 from an aperture 904 in the platform 902 and pivoting the spacer arm 108 about an axis of rotation coaxial with the fastener 204 until an aperture 110 in the spacer rod 108 is aligned with an aperture 908 in the platform 902 that is along the line extending through attachment portion 204 in the longitudinal direction with respect to the kayak. The user then inserts the removable fastener 906 through the aperture 908 in the platform 902. The spacer arm 108 is secured in the longitudinal position, which is substantially parallel to a line extending from the rear of the kayak to the front of the kayak.

Figure 12:
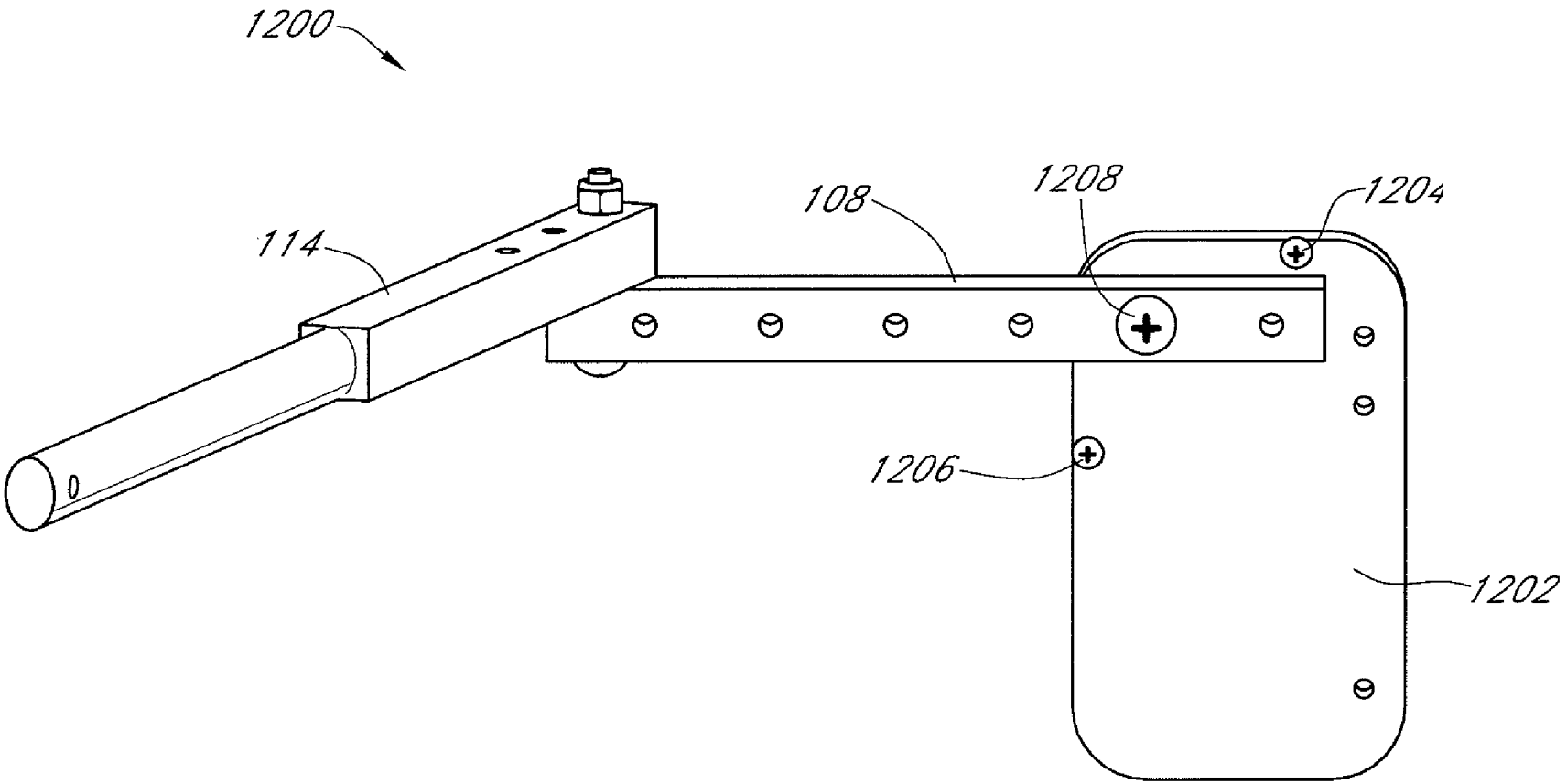
FIG. 12 depicts an embodiment of a mounting apparatus with a freely rotatable spacer arm.

In the embodiment shown in FIG. 12, a mounting apparatus 1200 includes a base 1202 with a first post 1204 and a second post 1206. The spacer arm 108 is connected to the base 1202 with a connector 1208 that allows the spacer arm 108 to freely pivot. The range of angles through with the spacer arm 108 can pivot is limited by the posts 1204, 1206 so that the spacer arm 108 can pivot between a substantially longitudinal position or stored position and a deployed position. The posts 1204, 1206 can be any suitable structure, such as, for example, fasteners, screws, nails, molded plastic, protrusions from the base 1202, or another material. In some embodiments, the spacer arm 108 can be deployed in a substantially transverse position or at an angle between the transverse position and the stored position. In some embodiments, the posts 1204, 1206 are positioned to allow the spacer arm 108 to be pivoted through an angle measuring approximately 90°. The posts 1204, 1206 may be positioned at other locations on the base 1202 in order to give the spacer arm 108 any suitable range of rotation, such as a range of rotation less than 90° or greater than 90°.

In some embodiments, the spacer arm 108 pivots freely about an axis of rotation coaxial with the elongate axis of the connector 1208. In some embodiments, the spacer arm 108 is connected to the base 1202 such that a suitable amount of friction holds the spacer arm in a position determined by an operator of the mounting apparatus 1200. For example, a certain amount of force may be required to pivot the spacer arm 108, such as an amount that could be reasonably manually supplied by the operator of the apparatus 1200. When the operator stops pushing on the spacer arm 108, the arm 108 can stay in the place where the operator left it.

The spacer arm 108 is pivotably connected to a transducer arm 114. In the embodiment shown in FIG. 12, the spacer arm 108 is no more than about half the length of the transducer arm 114. However, the lengths of the spacer arm 108 and the transducer arm 114 can be adjusted to any suitable length. In some embodiments, the lengths of the arms 108, 114 are selected to make the apparatus 1200 more compact when in a stored position. In some embodiments, the lengths of the arms 108, 114 are selected to enable a transducer end 1210 of the deployment arm 114 to reach the surface of the water when the apparatus 1200 is mounted to a waterborne vessel.

Figure 13:
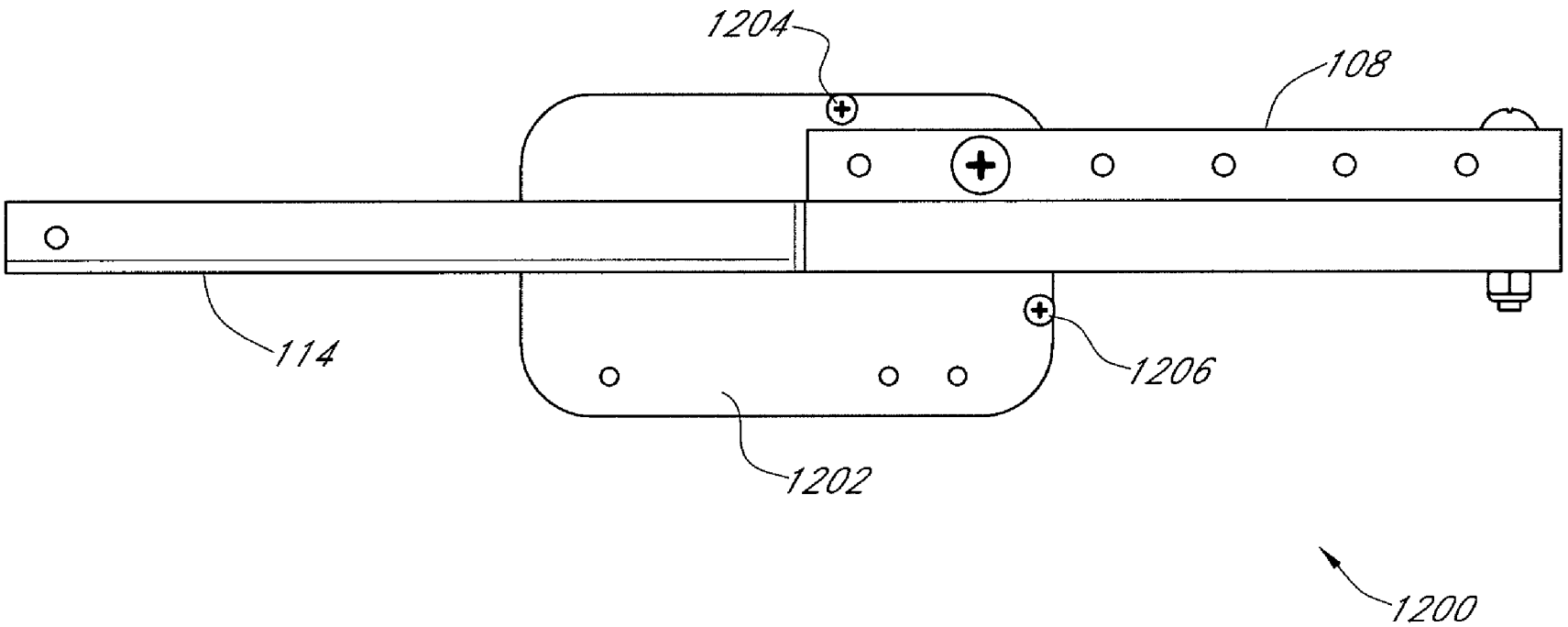
FIG. 13 depicts the embodiment of FIG. 12 with a folded spacer arm and transducer arm.

In the embodiment shown in FIG. 13, the mounting apparatus 1200 is folded into a stored position. In the stored position, the spacer arm 108 is situated into a longitudinal orientation with respect to the base 1202, and a side of the spacer arm 108 rests against a first post 1204. The transducer arm 114 is pivoted to be substantially parallel to the spacer arm 108. As shown in FIG. 13, a side of the transducer arm 114 rests against a second post 1206 such that the stored transducer arm 114 and spacer arm 108 can be secured between the posts 1204, 1206. In some embodiments, pivoting the transducer arm 114 away from the base 1202 allows the spacer arm 108 to rotate away from the longitudinal position shown in FIG. 13. The spacer arm 108 can be rotated to various angles as described in the context of FIG. 12 when the transducer arm 114 is rotated away from an orientation parallel to the spacer arm.

Some embodiments provide a method of using an equipment mount to deploy a transducer from a waterborne vessel. The method can include securing a base to a deck of the waterborne vessel. The base can be connected to a spacer arm, and a transducer arm can be pivotably attached to the spacer arm. The method can further include providing an instrument having a display unit and a transducer. The display unit can be disposed on the base. The method can include fastening the transducer to an end of the transducer arm opposite a portion of the transducer arm attached to the spacer arm and swinging the transducer arm to rotate the transducer arm from a stored position to a deployed position. In certain embodiments, the transducer arm is parallel to or collinear with the spacer arm when the transducer arm is in the stored position. The transducer is positioned underwater when the transducer arm is in the deployed position.

In some embodiments, an operator of the equipment mount can point the transducer in a desired direction. For example, the operator can select a measurement direction for the transducer by adjusting the deployment angle of the transducer arm. The measurement direction for the transducer can also be selected by adjusting the spacer arm angle of the spacer arm. In certain embodiments, the spacer arm can be stored by rotating the spacer arm into a longitudinal position with respect to the waterborne vessel and securing the spacer arm in the longitudinal position.

Reference throughout this specification to "some embodiments," "certain embodiments," or "an embodiment" means that a particular feature, structure or characteristic described in connection with the embodiment is included in at least some embodiments. Thus, appearances of the phrases "in some embodiments" or "in an embodiment" in various places throughout this specification are not necessarily all referring to the same embodiment and may refer to one or more of the same or different embodiments. Furthermore, the particular features, structures or characteristics may be combined in any suitable manner, as would be apparent to one of ordinary skill in the art from this disclosure, in one or more embodiments.

As used in this application, the terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Similarly, it should be appreciated that in the above description of embodiments, various features are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that any claim require more features than are expressly recited in that claim. Rather, inventive aspects lie in a combination of fewer than all features of any single foregoing disclosed embodiment.

Although the inventions presented herein have been disclosed in the context of certain preferred embodiments and examples, it will be understood by those skilled in the art that the inventions extend beyond the specifically disclosed embodiments to other alternative embodiments and/or uses of the inventions and obvious modifications and equivalents thereof. Thus, it is intended that the scope of the inventions herein disclosed should not be limited by the particular embodiments described above.

What is claimed is:

1. An apparatus for mounting equipment on a waterborne vessel, the apparatus comprising:

a base member;

an elongate spacer arm connected to the base member, the elongate spacer arm comprising:

a base member end configured to connect to the base member; and a distal end opposite the base member end;

wherein the length of the spacer arm is at least sufficient for the distal end to reach a gunwale of the vessel when the base member is mounted inboard the vessel;

and a selectively deployable elongate transducer arm pivotably coupled to the spacer arm, the elongate transducer arm comprising:

a proximal end configured to pivotably connect to the distal end of the spacer arm at a pivot point; and a transducer end opposite the proximal end, the transducer end being configured to attach to a transducer;

wherein the transducer arm is configured to pivot between a deployed position and a stored position; and wherein the length of the transducer arm is at least sufficient for the transducer end to reach the water surface when the transducer arm is in the deployed position;

wherein the spacer arm is substantially parallel to or collinear with the transducer arm when the transducer arm is in the stored position, allowing the apparatus to be folded for compact storage; and wherein the spacer arm is movable with respect to the base member such that, when the spacer arm is in a stored position, the distal end and the pivot point are inboard the vessel and, when the spacer arm is in a deployed position, the distal end and the pivot point are outboard the vessel while the base member remains mounted inboard the vessel.

2. The apparatus of claim 1, wherein at least one of the spacer arm and the transducer arm is configured to telescope so as to have an adjustable length.

3. The apparatus of claim 1, further comprising a mount member configured to sit on a deck of the vessel and secure the base member to the vessel.

4. The apparatus of claim 1, wherein the base member is configured to sit on a deck of the vessel, and wherein the base member comprises a fastener to secure the base member to the vessel.

5. The apparatus of claim 1, wherein the base member comprises a substantially planar surface sized to support the display of a fish finder.

6. The apparatus of claim 5, wherein the spacer arm is pivotally connected to the base member such that the spacer arm can be rotated within a plane parallel to the substantially planar surface of the base member.

7. The apparatus of claim 6, further comprising a spacer arm locking pin configured to anchor the position of the spacer arm at a spacer arm angle with respect to the base member, wherein the base member comprises a plurality of locking pin receptacles such that the spacer arm can be anchored in a plurality of different positions.

8. The apparatus of claim 6, further comprising one or more post members extending from the base member, wherein the one or more post members restrict an angle through which the spacer arm can be rotated.

9. The apparatus of claim 8, wherein the one or more post members comprise two post members that allow the spacer arm to be rotated through an angle of approximately 90°.

10. A method of using an equipment mount to deploy a transducer from a waterborne vessel, the method comprising:

securing a base to an inboard deck of the waterborne vessel, wherein the base is connected to a spacer arm and to a transducer arm, wherein the transducer arm is pivotably attached to the spacer arm at a pivot point;

providing an instrument having a display unit and a transducer, wherein the display unit is disposed on the base;

fastening the transducer to an end of the transducer arm opposite a portion of the transducer arm attached to the spacer arm;

moving the spacer arm with respect to the base member from a stored position, in which a distal end of the spacer arm and the pivot point are inboard the vessel, to a deployed position, in which the distal end and the pivot point are outboard the vessel while the base remains mounted inboard the vessel; and swinging the transducer arm about the pivot point to rotate the transducer arm from a stored position to a deployed position;

wherein the transducer arm is parallel to or collinear with the spacer arm when the transducer arm is in the stored position; and wherein the transducer is positioned underwater when the transducer arm is in the deployed position.

11. The method of claim 10, further comprising selecting a measurement angle for the transducer by adjusting a deployment angle of the transducer arm.

12. The method of claim 10, further comprising selecting a measurement angle for the transducer by adjusting a spacer arm angle of the spacer arm.

13. The method of claim 10, further comprising rotating the spacer arm into a longitudinal position with respect to the waterborne vessel and securing the spacer arm in the longitudinal position.

* * * * *